United States Patent [19]

Meyer

[11] 4,287,608

[45] Sep. 8, 1981

[54] APIARIAN PROTECTOR

[76] Inventor: Michael S. Meyer, Rte. 1, Box 175, Monmouth, Oreg. 97361

[21] Appl. No.: 42,806

[22] Filed: May 29, 1979

[51] Int. Cl.[3] ..... A41D 13/08

[52] U.S. Cl. ..... 2/16; 139/420 R

[58] Field of Search ..... 2/16, 59, DIG. 1, 126, 2/159, 167, 158, 161 R, 170; 139/420 R, 426 R

[56] References Cited

U.S. PATENT DOCUMENTS

| | | | |
|---|---|---|---|
| 338,790 | 3/1886 | Slack | 2/159 |
| 532,880 | 1/1895 | Huckle | 2/158 |
| 1,296,430 | 3/1919 | Riley | 2/59 |
| 1,791,581 | 2/1931 | Stokes | 2/159 |
| 2,074,390 | 3/1937 | Green | 2/161 R |
| 2,314,922 | 3/1943 | Chanut | 2/159 |
| 2,619,705 | 12/1952 | Foster | 139/420 R |
| 2,784,409 | 3/1957 | Slipakoff | 2/4 |

OTHER PUBLICATIONS

Man-Made Textile Encyclopedia, 1959, p. 347, Table VII.

*Primary Examiner*—Doris L. Troutman
*Attorney, Agent, or Firm*—Kolisch, Hartwell & Dickinson

[57] ABSTRACT

An arm and hand protector for apiarian use. The protector includes a glove and an attached sleeve designed to fit loosely about, and cover the wearer's forearm. The sleeve is formed of a smooth-surfaced fabric tightly woven from a substantially untextured, synthetic filament yarn.

5 Claims, 4 Drawing Figures

APIARIAN PROTECTOR

BACKGROUND AND SUMMARY

The present invention relates to apiarian wear, and in particular, to wear formed of smooth-surfaced fabric tightly woven from untextured, synthetic filament yarn.

Heretofore, apiarian protective wear has been made from leather or heavy, course cloth material. An apiarian hand and arm protector well-known in the prior art includes a leather glove and an attached loose-fitting sleeve made of heavy cotton or wool material. The use of heavy cloth material in apiarian protective wear has been thought necessary to prevent bee-stinger penetration. However, there are disadvantages associated with such material. It can be quite hot and uncomfortable during the spring and summer months when bees are handled. Also, bees find the rough, fibrous surface of such fabric an attractive one for stinging. Once the fabric has been repeatedly stung, the scent of the absorbed bee venom tends to excite the stinging response of other bees, and a higher level of stinging activity may occur.

A general object of the present invention is to provide apiarian wear which is formed of lightweight, breathable fabric, having surface characteristics which deter bee stinging.

A more particular object of the present invention is to provide an apiarian hand and arm protector having a sleeve portion formed of such fabric.

The present invention includes apiarian wear formed of smooth-surfaced fabric tightly woven from substantially untextured, synthetic filament yarn. Specifically, the invention includes an arm and hand protector having a glove and an attached, loose-fitting sleeve formed of such fabric.

These and other objects and features of the present invention will become more readily apparent when considered in connection with the following detailed description of a preferred embodiment of the present invention and the accompanying drawings, wherein:

FIG. 1 is a side view of a hand and arm protector constructed according to the present invention.

FIG. 2*a* is a magnified view of the yarn and weave appearance of fabric suitable for use in the present invention.

FIG. 2*b* is a similarly magnified view of nylon mesh hosiery material.

FIG. 2*c* is a similarly magnified view of a staple yarn fabric typically used in prior art apiarian wear.

DETAILED DESCRIPTION OF THE INVENTION

Figure 1:
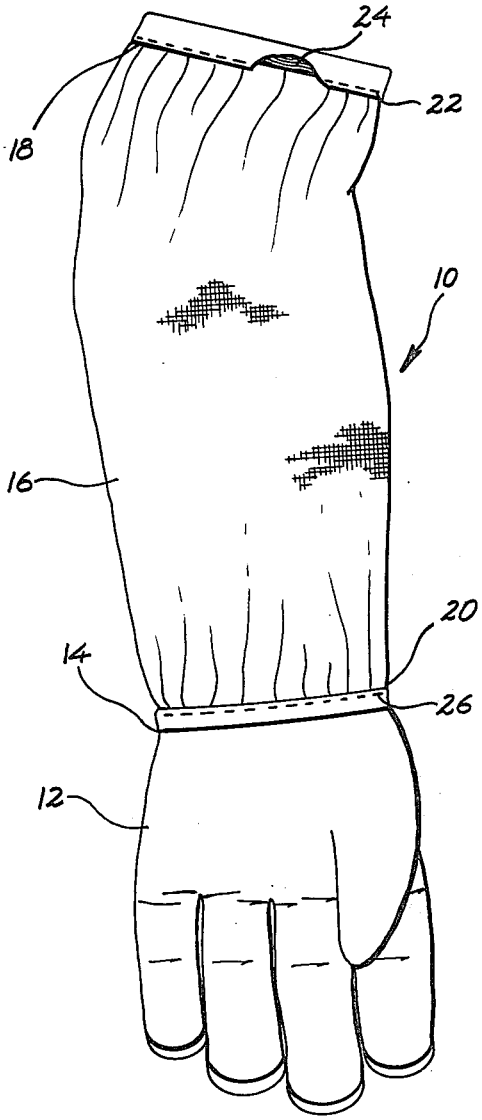

Referring to FIG. 1, there is shown at 10 an apiarian hand and arm protector constructed according to the present invention. Protector 10 generally includes a tight-fitting glove 12, having an open end 14 and, attached to and extending from this end, a sleeve 16 designed to cover the wearer's forearm.

Glove 12 is designed to fit tightly on the wearer's hand. End 14, when the glove is being worn, extends to the wrist region of the wearer. The glove is preferrably formed of smooth-surfaced leather, and is thick enough to prevent bee stinger penetration.

Sleeve 16 is formed of a smooth-surfaced, synthetic fabric material of a type to be described. The sleeve is designed to fit loosely about the wearer's forearm, and to extend thereon from a sleeve upper end 18, adjacent the wearer's elbow, to a sleeve lower end 20, which is attached to the glove's end 14. Upper end 18 is hemmed by conventional folded back and stitched construction, stitching of which is indicated by dotted line at 22. As seen in cutaway view in FIG. 1, an elastic band 24 is attached to end 18 by inclusion between the folds of the hem. Band 24 is dimensioned to elastically encircle the wearer's arm, adjacent the elbow, whereby the sleeve's upper end is securable to the wearer's arm.

At its lower end 20, sleeve 16 is pleated to reduce the sleeve's larger circumference to that of the glove's end 14, and these two just-mentioned ends are sewn together, circumferentially, by stitching which is indicated by dotted line at 26. Band 24 is also referred to herein as means for securing one sleeve end to the wearer's arm, adjacent the elbow. Stitching 26 is also referred to herein as seam means for joining the sleeve's lower end to the glove's open end. Glove 12 and the just-mentioned seam means are also referred to herein as means for binding the lower sleeve end adjacent the wearer's wrist, to prevent bees from penetrating underneath the sleeve.

According to an important feature of the present invention, the fabric used in forming sleeve 14 is tightly woven from a substantially untextured, synthetic filament yarn. A preferred fabric includes nylon cloth of a type commonly used in outdoor use, such as in tents, sleeping bags, or the like. As is known, nylon cloth of this type has a number of advantageous features: it is lightweight, strong, permits breathing, dries quickly, and is relatively nonabsorbent. The latter two features are related to the fact that the nylon yarn forming the fabric is relatively hydrophobic. Another property of such fabric, heretofore unknown, is that its surface acts to deter bee stinging. This property will now be discussed in detail.

Figure 2A:
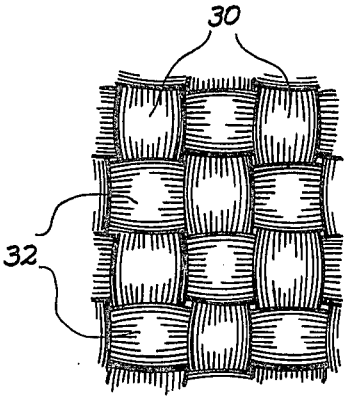

The surface appearance of a portion of the fabric forming sleeve 16 is shown in magnifield detail in FIG. 2*a*. As noted above, a preferred fabric used in forming sleeve 16 is tightly woven from untextured, filament nylon yarn. Typically, this yarn is formed by extrusion of between about 25 and 50 untextured, or linear nylon filament strands, which are twisted together slightly, e.g., about one twist per inch, to give the yarn cohesiveness. As is conventional, the yarns forming the fabric shown in FIG. 2*a* are identified as filing and wrap yarns, indicated at 30, 32 respectively. The thread count in a preferred fabric forming sleeve 16 is between about 100 and 300 total filing and wrap yarns per square inch. The fabric so formed has a substantially solid-weave, closed texture, meaning that the density of filing and wrap yarns is such as to form a substantially solid fabric with no openings. While a fabric formed of untextured, filament, nylon yarn has been disclosed, other untextured, synthetic filament yarns may be used. These may include acetate, polyester, acrylic, or virtually any other synthetic strand material which may be formed into untextured, filament yarn.

Figure 2B:
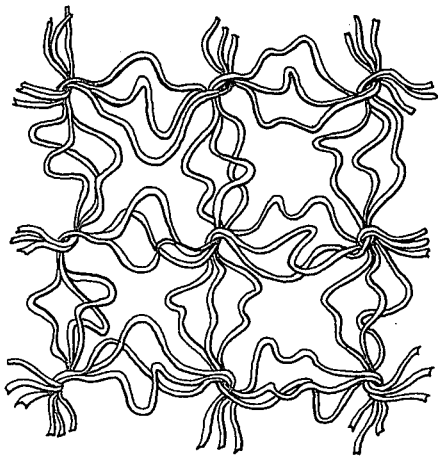
Figure 2C:
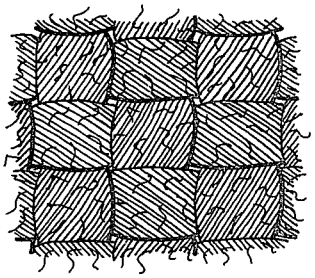

The solid-weave closed texture of the fabric shown in FIG. 2*a* contrasts with various known types of filamentous mesh and net material which are characterized by an irregular surface and/or visible mesh openings. One such mesh material, which is used in women's hosery, is shown in magnified view in FIG. 2*b*. As seen here, the surface texture is characterized by large openings and uneven weave. This fabric material has been found to be ineffective in deterring bee stinging. Also, as is well known to apiarists, open-weave mesh material such as mosquito netting having visible openings, but a more regular weave than the hose material shown in *2b*, is also ineffective in deterring bee stinging where the mesh material contacts the wearer's skin.

It can also be appreciated in FIG. *2a*, that the fabric employed in the present invention has a substantially nonfibrous surface texture, by which is meant there is a virtual absence of any free-end yarn strands at the fabric surface. This, of course, is related to the use of filament yarn in forming the fabric. A magnified view of a tightly-woven fabric formed of staple yarn, such as cotton yarn, is illustrated in magnified view in FIG. *2c*. The surface of such fabric, as can be appreciated, is characterized by multiple free-ended strands, which are, of course, the staple fibers forming the yarn. The staple yarn gives the material its soft, somewhat fuzzy surface texture. Fabric formed of either synthetic or natural staple yarns has been found to be ineffective in deterring bee stinging.

It is not well-understood why a nonfibrous, smooth-surfaced fabric deters bee stinging. However, it is postulated that the bee, in stinging, requires leverage or stabilization which may be obtained through "grasping" either a rough-surfaced or fibrous fabric. Such leverage would be unavailable to a bee on untextured, nonfibrous fabric.

From the foregoing, it can be appreciated how above-stated objects of the present invention are met. In particular, the smooth-surfaced, nonfibrous synthetic fabric used in forming the sleeve of apiarian wear provides such with a number of advantageous properties, the most important of which is that the surface of such fabric deters bee stinging. Other advantages, also mentioned above, are that the material is lightweight, permits breathing, and is substantially nonabsorbant. Thus, apiarian wear formed of this material, and in particular, the apiarian hand and arm protector described herein, may be worn with comfort and safety over long periods. Further, the relative inexpensiveness of the fabric material disclosed herein contributes to the advantage of apiarian wear disclosed herein.

The use of fabric formed of a tightly-woven, substantially untextured synthetic yarn in apiarian wear, and a hand and arm protector formed of such fabric has thus been disclosed. It is recognized that various modifications and changes may be made in the present invention without departing from the spirit thereof.

It is claimed and desired to secure by Letters Patent:

1. Apiarian hand and arm protector comprising a sleeve formed of a solid-weave, closed-texture fabric woven from synthetic filament yarn, said sleeve being designed to fit loosely about the wearer's forearm, and extend thereon adjacent the wearer's elbow, at one sleeve end to the wearer's wrist, at the other sleeve end, means for securing said one sleeve end to the wearer's arm, adjacent the elbow, and means for binding the other sleeve end adjacent the wearer's wrist, to prevent bees from penetrating therebetween.

2. The protector of claim 1 wherein said securing means includes an elastic band attached to portions of said one end, and dimensioned to elastically encircle the wearer's arm adjacent the elbow.

3. The protector of claims 1 or 2 which further includes a glove having an open end, which, when the glove is worn, extends to the wearer's wrist, and wherein said binding means includes seam means for joining circumferentially said sleeve's other end and said glove's open end.

4. The wear of claims 1 or 2 wherein said yarn is nylon and said fabric has a thread count of between about 100 and 300 total warp and filing threads per square inch.

5. A method of protecting a person's arm from bee stinging comprising covering the arm with a loose-fitting sleeve formed of a solid-weave, closed-texture fabric woven from synthetic filament yarn.

* * * * *